United States Patent [19]

Modschiedler

[11] Patent Number: 4,722,698

[45] Date of Patent: Feb. 2, 1988

[54] CAPTURE FACILITATING DEVICE FOR PLUG CONNECTOR ASSEMBLY

[75] Inventor: Kurt Modschiedler, Neunkirchen, Fed. Rep. of Germany

[73] Assignee: Siemens Aktiengesellschaft, Fed. Rep. of Germany

[21] Appl. No.: 915,087

[22] Filed: Oct. 3, 1986

[30] Foreign Application Priority Data

Oct. 30, 1985 [DE] Fed. Rep. of Germany ..... 3538630

[51] Int. Cl.[4] ..... H01R 13/64

[52] U.S. Cl. ..... 439/374

[58] Field of Search ..... 339/65, 66 R, 66 M, 339/91 R; 439/374–377, 350–354, 357, 358

[56] References Cited

U.S. PATENT DOCUMENTS

| | | | |
|---|---|---|---|
| 3,042,894 | 7/1962 | Fox | 339/142 |
| 3,133,777 | 5/1964 | Anhalt | 339/91 R |
| 3,824,525 | 7/1974 | Keller | 339/91 R |
| 3,828,302 | 8/1974 | Cieniawa et al. | 339/91 R |
| 3,887,259 | 6/1975 | Ayer | 339/119 R |
| 4,204,737 | 5/1980 | Faber et al. | 339/65 |
| 4,544,225 | 10/1985 | Raus et al. | 339/91 R |
| 4,548,455 | 10/1985 | Ezure | 339/91 R |

*Primary Examiner*—Gil Weidenfeld
*Assistant Examiner*—Gary F. Paumen
*Attorney, Agent, or Firm*—Kenyon & Kenyon

[57] ABSTRACT

A capture facilitating device is provided for a subminiature plug connector assembly comprising a plug connector and a socket connector each having a protective collar attached perpendicularly to a mounting plate and each provided at a free end with a beveled edge. The frame of the capture facilitating device has a plurality of plate-shaped resilient support elements each attached at one end to the frame and provided at an opposite end with respective wedge-shaped capturing elements. The capturing elements overlap respective portions of the beveled edge of the protective collar of the plug connector in an assembled state of the plug connector and the capture facilitating device. The frame of the capture facilitating device is braced against the mounting plate of the plug connector by means of a pair of bell-shaped leaf springs attached to the frame of the capture facilitating device and engaging the mounting plate of the plug connector. The resiliently mounted wedge-shaped capturing elements serve to guide the socket connector collar into the plug connector collar during an insertion operation and increase the capturing range of the subminiature plug connector assembly.

20 Claims, 3 Drawing Figures

CAPTURE FACILITATING DEVICE FOR PLUG CONNECTOR ASSEMBLY

BACKGROUND OF THE INVENTION

This invention relates to a plug connector assembly, and more particularly, to a capture facilitating device in a subminiature plug connector assembly.

Subminiature plug connector assemblies each comprise a pin strip and a jack strip. The pin strip has a mounting plate, a plurality of pins extending perpendicularly with respect to the mounting plate and a protective collar attached to the mounting plate and surrounding the pins. The jack strip similarly has a mounting plate and a multiplicity of jacks registrable with and adapted to receive respective ones of the pins of the pin strip in an assembled state of the plug connector assembly. The jack strip has a protective collar attached to the respective mounting plate and surrounding the jacks.

Such subminiature plug connector assemblies are commercially available and find application in information technology text and data processing, and measuring and control engineering and for the connection of peripheral equipment. The standardized basic design of these subminiature plug connectors includes soldering lugs, straight soldering pins and angled-off soldering pins.

The protective collar on a pin strip serves to protect the contacts, to guide the jack strip and pin strip during assembly and to assure noninterchangability. The pin strips are mounted on a circuit board, while the jack strips are mounted to a module carrier. The maximum offset of the plug connector elements is only 0.6 mm. This range may not be sufficient because the required tolerances cannot always to be adhered to in the design of circuit boards or of module carriers in a production context. In order to achieve reliable contacts nevertheless, expensive rework must be performed.

As disclosed in U.S. Pat. No. 4,204,737, a capture facilitating device for a jack strip comprises a frame provided with guiding elements beveled in a direction facing towards the end face of the jack strip. In addition, the frame of the capture facilitating device is provided with support elements for bracing the frame against the end face of the jack strip. The counter piece of the jack strip is a circuit board, the contact area of which is provided with contact fingers on both sides. In addition, the capture facilitating device is connected to the jack strip in a detachable but immovable manner, with the aid of shoulders of the jack strip and the support elements of the frame of the capturing device. Because in the assembly disclosed in U.S. Pat. No. 4,204,737, a circuit board provided with contact fingers is used as the pin strip, the capturing range of the pin and jack strip combination is already large enough and does not require a capturing device. Moreover, the capturing device of this patent is not connected movably to the jack strip in the insertion direction of the pin strip, with the consequence that the pin strip must always be designed as part of a circuit board.

An object of the present invention is to provide an improved plug connector assembly, including a capture facilitating device, of the above-described type.

Another object of the present invention is to provide an improved capture facilitating device for the above-described type of plug connector assembly.

Another, more particular, object of the present invention is to provide such an improved capture facilitating device wherein the capturing range for an associated subminiature plug connector assembly is substantially increased, while the handling is simple.

SUMMARY OF THE INVENTION

The present invention is directed specifically to a capture facilitating device for use in a plug connector assembly comprising a pin strip and a jack strip, and more broadly to the overall assembly including the capture facilitating device.

Pursuant to the present invention, the pin strip has a first mounting plate, a multiplicity of pins extending perpendicularly with respect to the mounting plate and a first protective collar attached to the mounting plate and surrounding the pins. The protective collar of the pin strip has a first beveled free edge at an end spaced from the mounting plate of the pin strip. In addition, the jack strip has a second mounting plate and a multiplicity of jacks registrable with and adapted to receive respective ones of the pins in an assembled state of plug connector assembly. The jack strip further has a second protective collar attached to the second mounting plate and surrounding the jacks. The protective collar of the jack strip has a second beveled free edge of an end spaced from the mounting plate of the jack strip.

In accordance with the present invention, the capture facilitating device includes a frame with a plurality of surfaces facing inwardly, upon a mounting of the capture facilitating device to the pin strip or the jack strip, towards the respective protective collar. The inwardly facing surfaces of the frame face a central region defined by the frame for the reception of the protective collars of the two strips. Advantageously, one of the protective collars is larger than the other for receiving that other collar in a telescoping manner during a mounting of the jack strip to the pin strip.

Support means are provided on the frame of the capture facilitating device for supporting the larger of the first and the second protective collar (and, concomitantly, the associated strip) in a predetermined position with respect to the frame. The support means engages the larger of the protective collars in an assembled state of the capture facilitating device and the strip associated with the larger collar.

The capture facilitating device further includes a plurality of wedge-shaped capturing elements resiliently mounted to the frame at the inwardly facing surfaces thereof for guiding the protective collars into one another (i.e., the smaller collar into the larger collar) and the pins into the jacks during a mounting of the jack strip to the pin strip. A bracing spring is provided on the frame for engaging the mounting plate associated with the larger protective collar and for biasing the capture facilitating device away from that mounting plate. The wedge-shaped capturing elements overlap respective portions of the beveled edge of the larger protective collar upon the mounting of the capture facilitating device to the strip associated with the larger protective collar.

In a capture facilitating device in accordance with the invention, the capturing range is determined by the design of the web-shaped capturing elements, particularly the size and slant of the chamfered surfaces of the wedge-shaped capturing elements on the sides thereof facing the strip associated with the smaller protective collar. The wedge-shaped capturing elements are resiliently arranged on the frame of the capture facilitating device and cover respective portions of the beveled edge of the larger protective collar prior to assembly of the pin strip and the jack strip.

During assembly of the pin strip and the jack strip, for example, during the insertion of a circuit board provided with a pin strip and a capturing device into a module carrier provided with a jack strip, the beveled edge of the protective collar of the jack strip engages the leading chamfer of the capturing elements. Upon further insertion of the circuit board, the floating jack strip is aligned by means of the wedge-shaped capturing elements, while those elements move outwardly, owing to a camming type action, away from the central region defined by the frame of the capture facilitating device. When the smaller protective collar (e.g., of the jack strip) enters the region bounded by the larger protective collar (of the pin strip), the wedge-shaped capturing elements are disposed outwardly from the larger protective collar. Upon further motion of the pin strip and the jack strip towards one another, i.e., upon further insertion of the circuit board up to its end position, the capture facilitating device is pushed against the mounting plate of the one strip by the mounting plate of the other strip. In this process, the springs on the frame of the capture facilitating device are compressed.

Upon removal of the circuit board from the module carrier, i.e., upon the removal of the jack strip from the pin strip, the bracing springs push the capturing device away from the mounting plate of the strip associated with the larger protective collar (usually the pin strip). As soon as the contact is broken between the two strips, the wedge-shaped capturing hooks move inwardly to cover the respective portions of the beveled edge of the larger protective collar.

In a capture facilitating device of a plug connector assembly in accordance with the present invention, the capturing range of the plug connector components is substantially increased, whereby expensive rework for reliable contact formation is eliminated. Presently existing manufacturing tolerances are acceptable. Owing to the simple design and to the simple handling of a capture facilitating device in accordance with the present invention, equipment in which plug connectors are used can be retrofitted by the user himself.

Pursuant to another particular feature of the present invention, the frame of the capture facilitating device is provided with retaining hooks adapted to engage the mounting plate of the strip associated with the larger of the protective collars, preferably the pin strip. The retaining hooks enable a cpative mounting of the capture facilitating device to the protective collar of the pin strip.

In accordance with yet another particular feature of the present invention, the wedge-shaped capturing elements are provided on the supports on the frame. Preferably, the supports take the form of resilient plate members each attached at one end to the frame of the capture facilitating device and provided at an opposite end with a respective wedge-shaped capturing element. This configuration reduces the space required in the frame and simplifies the design of the capture facilitating device. Moreover, forces exerted during a mounting of the jack strip to the pin strip are transmitted via the wedge-shaped capturing elements to the capture facilitating device over the support members, thereby improving operability while reducing frame material.

In an advantageous embodiment of the capture facilitating device, the bracing spring or springs on the frame take the form of leaf springs each having a bell-shaped elevation and provided at their free ends with retaining hooks. This particular embodiment is especially space-saving, whereby very small subminiature plug connector assemblies can be provided with capture facilitating devices.

Advantageously, in a capture facilitating device in accordance with the present invention, the wedge-shaped capturing elements, the leaf springs and the support members are all integrally connected to the frames of the capture facilitating devices, whereby the devices may be produced in one manufacturing operation as unitary injection molded parts.

DETAILED DESCRIPTION

Figure 1:
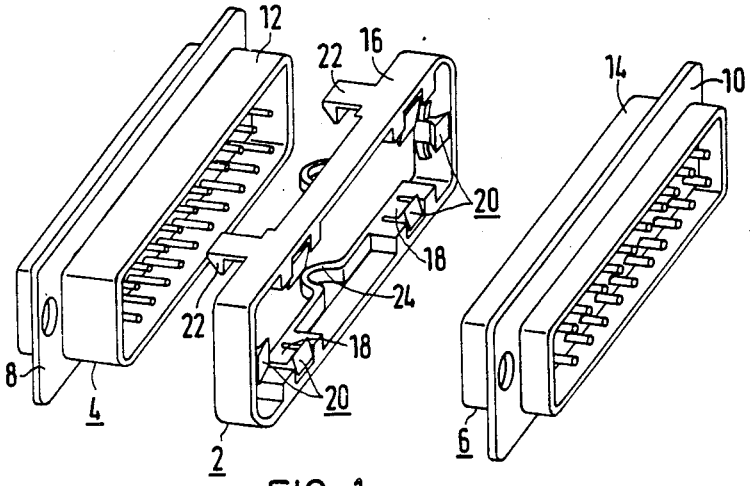
FIG. 1 is an exploded perspective view of a plug connector assembly including a capture facilitating device in accordance with the present invention.
Figure 2:
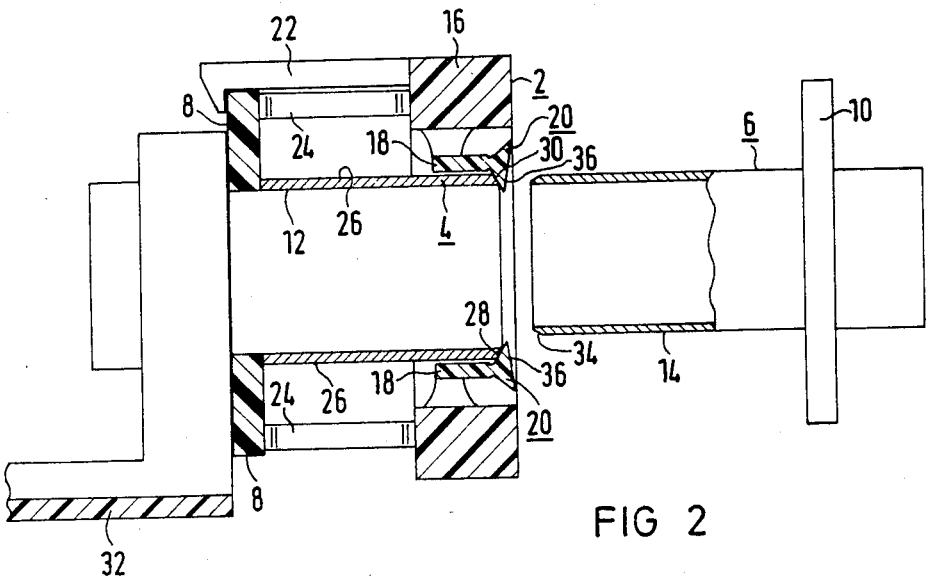
FIG. 2 is a cross-sectional view of the plug connector assembly of FIG. 1, showing the capture facilitating device mounted to a pin strip and awaiting the mounting of a jack strip to the pin strip.

FIG. 1 shows a plug connector assembly including a pin strip 4, a jack strip 6 and a capture facilitating device 2. Pin strip 4 includes a mounting plate 8, a multiplicity of pins 42 extending perpendicularly with respect to the mounting plate and a protective collar 12 attached to the mounting plate and surrounding the pins. Jack strip 6 similarly comprises a mounting plate 10 and a multiplicity of jacks (not visible in the diagram) registrable with and adapted to receive respective ones of the pins 42 in an assembled state of the plug connector assembly. Jack strip 6 further includes a protective collar 14 attached to mounting plate 10 and surrounding the jacks. As best seen in FIG. 2, protective collar 12 has a beveled free edge 28 at an end of the collar spaced from mounting plate 8. Collar 14 of the jack strip likewise has a beveled free edge 34 at an end of the collar spaced from mounting plate 10. As illustrated in FIG. 2, each collar 12 and 14 has an elongate trapezoidal cross-section.

Capture facilitating device 2 comprises a rectangular frame 16 provided on an inner side with support elements 18 in the form of resilient plates each connected at one end to frame 16 and provided at an opposite end with a respective wedge-shaped capturing element 20. Support members or plates 18 define surfaces which together with adjacent surfaces of frame 16 define a substantially rectangular central region for the reception of protective collars 12 and 14. In an assembled state of the plug connector assembly, support members 18 serve to support the larger of the two collars 12 and 14, preferably pin strip collar 12, in a predetermined position with respect to capture facilitating device 2. The relative positions of pin strip 4 and capture facilitating device 2 are also maintained with the aid of a pair of bracing springs 24 and a pair of retaining hooks 22. Bracing springs 24 engage mounting plate 8 of pin strip 4 and serve to bias the capture facilitating device 2 away from that mounting plate. The biasing action of springs 24 is countered by the action of retaining hooks 22 which engage mounting plate 8 on a side thereof opposite capture facilitating device 2.

Bracing springs 24 are advantangeously formed as elongate leaf springs having bell-shaped elevations (see FIG. 1) and attached at their opposite ends to frame 16 of capture facilitating device 2. Accordingly, leaf springs 24 have middle portions which engage mounting plate 8 in an assembled state of pin strip 4 and capture facilitating device 2 (see FIG. 2). Leaf springs may be made of spring steel or synthetic resin material. In the case of spring steel, the free ends of the leaf springs 24 are snapped into frame 16 of capture facilitating device 2. If, on the contrary, leaf springs 24 are made of the same synthetic resin material as frame 16 of capture facilitating device 2, the entire device, including springs 24, support members 18, wedge-shaped capturing elements 20 and retaining hooks 22, is fabricated as a unitary injection molded part.

As illustrated in FIG. 2, support elements 18 of frame 16 lie against outside surface 26 of protective collar 12, frame 16 being braced against mounting plate 8 of pin strip 4 by means of bell-shaped leaf springs 24. Retaining hooks 22 engage a rear side of mounting plate 8, while capturing hooks or elements 20 overlap respective portions of chamfered edge 28 of protective collar 12. Each wedge-shaped capturing element 20 has a first chamfered edge or surface 30 engaging the respective portion of beveled edge 28 of collar 12 in an engaged or assembled state of pin strip 4 and capture facilitating device 2. Each wedge-shaped capturing element 20 also has a chamfered leading edge or surface 36 which engages beveled edge 34 of protective collar 14 during an insertion stroke of that collar into collar 12. Leading chamfers 36 serve to align and guide jack strip 6 with respect to pin strip 4 during the insertion operation.

As illustrated in FIG. 2, pin strip 4 is provided on a circuit board 32. Capturing device is likewise provided in a module carrier (not illustrated for purposes of clarity). During insertion of the circuit board into the module carrier, the assembly of pin strip 4 and jack strip 6 is effectuated. Upon an initial engagement of leading edges 36 of capturing elements 20 with beveled edge 34 of protective collar 14, capturing hooks 20, which are resiliently attached to frame 16, move outwardly away from the rectangular space defined in the center of frame 16, owing to a camming type action arising from beveled edge 28 of protective collar 12 and chamfered surface 30 of capturing element 20.

The wedge-shaped guiding or capturing elements 20 ensure that protective collars 12 and 14 are disposed axially aligned opposite one another during the insertion of circuit board 32 into the module carrier. Upon continued insertion of the circuit board, protective collar 14 of jack strip 6 is shifted into the region bounded by protective collar 12 of pin strip 4. As soon as mounting plate 10 of jack strip 6 engages frame 16 of capturing device 2, a force arises on frame 16, which force is directed against the force exerted by bracing springs 24. Continued insertion of circuit board 32 results in frame 16 being pushed towards mounting plate 8 of pin strip 4, whereby retaining hooks 22 are bent outwardly by a camming action, pass the edge of mounting plate 8 and subsequently snap into position on the rear surface of the mounting plate.

Upon the termination of the insertion operation, wedge-shaped guiding or capturing elements 20 are disposed on the outside surface 26 of protective collar 12. If pin strip 4 makes full contact with jack strip 6, capture facilitating device is arranged between mounting plates 8 and 10.

If circuit board 32 is pulled out of the module carrier, frame 16 of capture facilitating device 2 shifts away from mounting plate 8 under the influence of bell-shaped leaf springs 24. As soon as protective collar 14 of jack strip 6 is removed from the region bounded by collar 12 of pin strip 4, the wedge-shaped capturing elements 20 spring into their rest positions overlapping respective portions of beveled edge 28 of protective collar 12. Retaining hooks 22 serve to prevent the capture facilitating device from being removed from pin strip 4 and consequently lost.

Capture facilitating device 2 for subminiature plug connector assemblies is of simple design, is easy to assemble and substantially increases the capturing range of the plug connector assembly, whereby expensive rework is eliminated.

Figure 3:
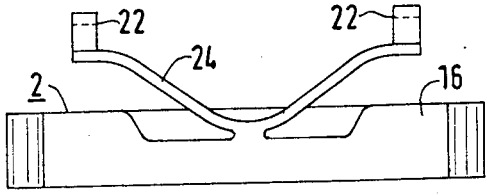
FIG. 3 is a top view of another capture facilitating device in accordance with the present invention.

As illustrated in FIG. 3, frame 16 of capture facilitating device 2 may be provided with one or more bracing springs 24' with bell-shaped elevations having middle portions attached to frame 16 and end portions provided with retaining hooks 22'. The design set forth in FIG. 3 is a particularly space-saving capture facilitating device.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A subminiature plug connector assembly comprising:

a plug connector having a first mounting plate, a multiplicity of pins extending perpendicularly with respect to said mounting plate and a first trapezoidal, protective collar attached to said mounting plate and surrounding said pins, said protective collar having a first beveled free edge at an end spaced from said mounting plate;

a socket connector having a second mounting plate and a multiplicity of sockets registrable with and adapted to receive respective ones of said pins in an assembled state of said assembly, said socket connector further having a second trapezoidal protective collar attached to said second mounting plate and surrounding said sockets, said second protective collar having a second beveled free edge at an end spaced from said second mounting plate; and a capture facilitating device including a frame with a plurality of surfaces facing inwardly towards one of said first protective collar and said second protective collar upon mounting of said capture facilitating device to the respective one of said plug connector and said socket connector, said capture facilitating device also including support means on said surfaces for supporting said respective one of said plug connector and said socket connector in a predetermined position with respect to said frame, said support means engaging said one of said first and protective collar and said second protective collar upon mounting of said capture facilitating device to said respective one of said plug connector and said socket connector, said capture facilitating device further including guiding means in the form of a plurality of wedge-shaped capturing elements resiliently mounted to said frame at said surfaces for guiding said first protective collar and said second protective collar into one another and said pins into said sockets during mounting of said socket connector to said plug connector, said capture facilitating device further including resilient means in the form of at least one spring on said frame for engaging the mounting space associated with said respective one of said plug connector and said socket connector and for biasing said capture facilitating device away therefrom upon mounting of said capture facilitating device to said respective one of said plug connector and said socket connector, said wedge-shaped capturing elements overlapping respective portions of the beveled edge of said one of said first protective collar and said second protective collar upon mounting of said capture facilitating device to said respective one of said plug connector and said socket connector and prior to mounting of said plug connector to said socket connector.

2. The plug connector assembly set forth in claim 1 wherein said frame is provided with as plurality of retaining hooks adapted to engage the mounting plate associated with said respective one of said plug connector and said socket connector on a side of such mounting plate opposite said capture facilitating device.

3. The plug connector assembly set forth in claim 1 wherein said wedge-shaped capturing elements are provided on said support means.

4. The plug connector assembly set forth in claim 3 wherein said support means includes a plurality of resilient plate-shaped members each attached at one end to said frame and carrying at an opposite end a respective one of said wedgeshaped capturing elements.

5. The connector assembly set forth in claim 1 wherein said spring takes the form of a leaf spring having a bell-shaped elevation.

6. The plug connector assembly set forth in claim 5 wherein said leaf spring has a pair of ends connected to said frame.

7. The plug connector assembly set forth in claim 5 wherein said leaf spring has a middle portion connected to said frame.

8. The plug connector assembly set forth in claim 7 wherein said leaf spring has a pair of free ends each provided with a respective holding hook.

9. The plug connector assembly set forth in claim 5 wherein said leaf spring is integral with said frame.

10. The plug connector assembly set forth in claim 1 wherein said capture facilitating device is an injection-molded part.

11. A capture facilitating device for use in a plug connector assembly comprising a plug connector and a socket connector, said plug connector having a first mounting plate, a multiplicity of pins extending perpendicularly with respect to said mounting plate and a first trapezoidal protective collar attached to said mounting plate and surrounding said pins, said protective collar having a first beveled free edge at an end spaced from said mounting plate, said socket connector having a second mounting plate and a multiplicity of sockets registrable with and adapted to receive respective ones of said pins in an assembled state of said assembly, said socket connector further having a second protective collar attached to said second mounting plate and surrounding said sockets, said second protective collar having a second beveled free edge at an end spaced from said second mounting plate, one of said first protective collar and said second protective collar being larger than the other for receiving said other in a telescoping manner, said capture facilitating device comprising:

a frame with a plurality of surfaces facing inwardly towards a central region defined by said frame for the reception of said first protective collar and said second protective collar;

support means on said frame at said surfaces for supporting the larger of said first protective collar and said second protective collar in a predetermined position with respect to said frame, said support means engaging said larger of said first protective collar and said second protective collar in an assembled state of the associated connector and said capture facilitating device;

guiding means in the form of a plurality of wedge-shaped capturing elements resiliently mounted to said frame at said surfaces for guiding said first protective collar and said second protective collar into one another and said pins into said sockets during mounting of said socket connector to said plug connector; and resilient means in the form of at least one spring on said frame for engaging the mounting plate associated with said larger of said first protective collar and said second protective collar and for biasing said capture facilitating device away from the mounting plate, said wedge-shaped capturing elements overlapping respective portions of the beveled edge of said larger of said first protective collar and said second protective collar upon mounting of said capture facilitating device to the one of said plug connector and said socket connector associated with said larger of said first protective collar and said second protective collar.

12. The capture facilitating device set forth in claim 11 wherein said frame is provided with retaining hooks adapted to engage the mounting plate associated with said larger of said first protective collar and said second protective collar.

13. The capture facilitating device set forth in claim 11 wherein said wedge-shaped capturing elements are provided on said support means.

14. The capture facilitating device set forth in claim 13 wherein said support means includes a plurality of resilient plate-shaped members each attached at one end to said frame and provided on an opposite end with a respective one of said wedge-shaped capturing elements.

15. The capture facilitating device set forth in claim 11 wherein said spring takes the form of a leaf spring having a bell-shaped elevation.

16. The capture facilitating device set forth in claim 15 wherein said leaf spring has a pair of ends connected to said frame.

17. The capture facilitating device set forth in claim 15, wherein said leaf spring has a middle portion connected to said frame.

18. The capture facilitating device set forth in claim 17 wherein said leaf spring has a pair of free ends each provided with a respective retaining hook.

19. The capture facilitating device set forth in claim 11 wherein said spring is integral with said frame.

20. The capture facilitating device set forth in claim 11 wherein said device is an injection-molded part.

* * * * *